US005331884A

United States Patent [19]

Ando

[11] Patent Number: 5,331,884

[45] Date of Patent: Jul. 26, 1994

[54] FLUID CYLINDER WITH COOLING PASSAGES

[75] Inventor: Etuo Ando, Tokyo, Japan

[73] Assignee: Ando Seisakujo Co., Ltd., Tokyo, Japan

[21] Appl. No.: 972,902

[22] Filed: Nov. 6, 1992

[30] Foreign Application Priority Data

Jun. 4, 1992 [JP] Japan ..... 4-170228

[51] Int. Cl.[5] ..... F01B 31/08; F16J 15/16

[52] U.S. Cl. ..... 92/108; 92/111; 92/186; 227/15; 227/16; 277/DIG. 8

[58] Field of Search ..... 92/108, 110, 144, 168, 92/87, 82, 111, 186; 277/15, 16, 22, DIG. 8

[56] References Cited

U.S. PATENT DOCUMENTS

| | | | |
|---|---|---|---|
| 323,749 | 8/1885 | Stitzel | 92/111 |
| 363,453 | 5/1887 | Ford | 92/111 |
| 1,788,298 | 1/1931 | Hottel | 92/110 |
| 2,953,119 | 9/1960 | Geyer | 92/111 X |
| 3,118,348 | 1/1964 | Kline | 92/108 X |
| 3,146,680 | 9/1964 | Hutter et al. | 92/111 X |
| 3,296,943 | 1/1967 | Rosman | 92/111 |
| 3,353,352 | 11/1967 | Gardner | 92/110 X |
| 3,604,056 | 9/1971 | Larsen | 277/16 X |
| 3,678,805 | 7/1972 | Weyman | 92/110 X |
| 4,036,113 | 7/1977 | Kunz | 92/111 |
| 4,907,495 | 3/1990 | Sugahara | 92/108 X |
| 4,961,372 | 10/1990 | Leonhartsberger | 92/110 X |
| 5,156,523 | 10/1992 | Maier | 277/22 X |

FOREIGN PATENT DOCUMENTS

| | | |
|---|---|---|
| 61-119609 | 7/1986 | Japan . |
| 64-25508 | 2/1989 | Japan . |

*Primary Examiner*—Edward K. Look
*Assistant Examiner*—John Ryznic
*Attorney, Agent, or Firm*—Walter C. Farley

[57] ABSTRACT

A space (32) is formed between an inner end of a fitting hole (31) formed in a piston (21) and a piston rod (22) and is positioned radially inside a sealing member (24). By circulating a cooling fluid through the space, the majority of heat which is transmitted to the piston rod (22) can be absorbed, preventing transmission of heat to the sealing member. The temperature of the sealing member is kept lower and its deterioration can be inhibited.

4 Claims, 1 Drawing Sheet

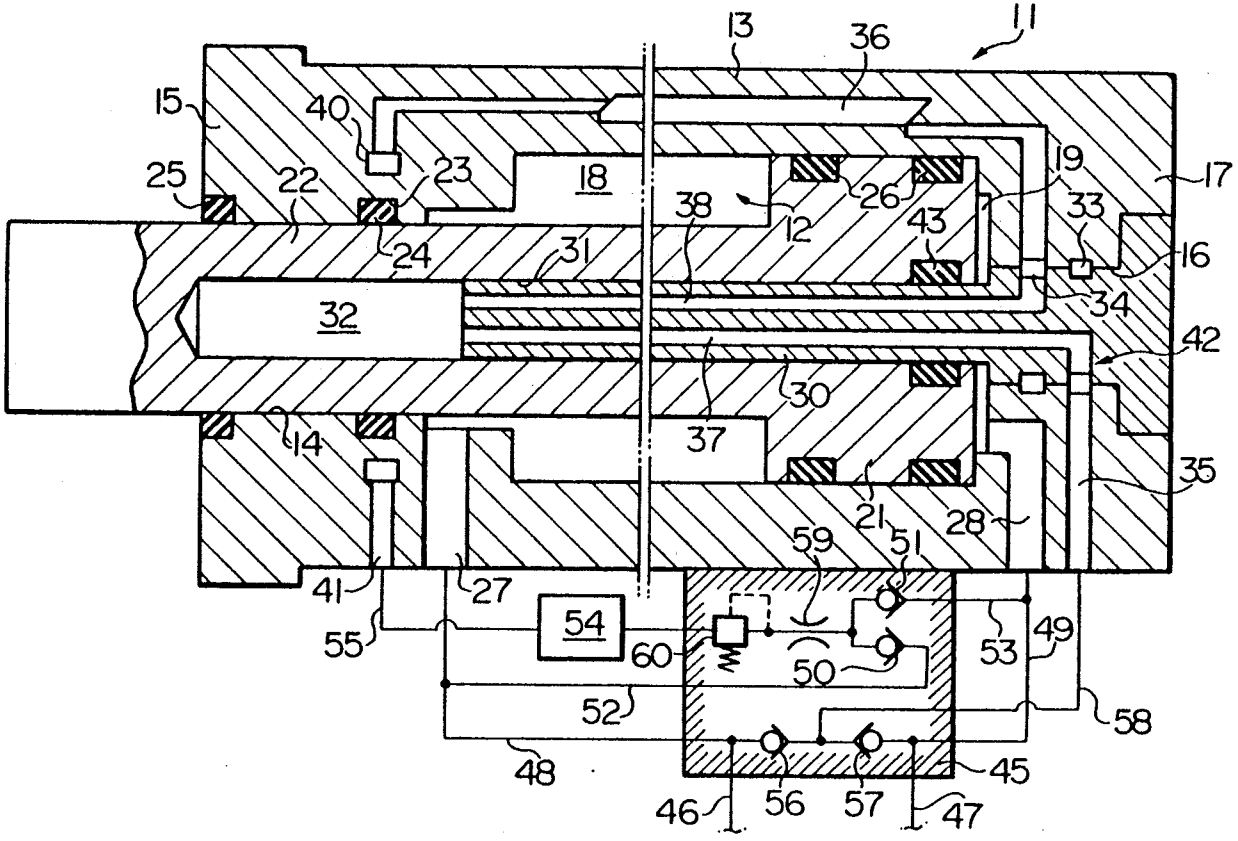
11
12
13
14
15
16
17
18
19
21
22
23
24
25
26
27
28
30
31
32
33
34
35
36
37
38
40
41
42
43
45
46
47
48
49
50
51
52
53
54
55
56
57
58
59
60

FLUID CYLINDER WITH COOLING PASSAGES

FIELD OF THE INVENTION

The present invention relates to a fluid cylinder which can be used at a high temperature.

RELATED BACKGROUND ART

In recent years, a cylinder for a core of a mold which is mounted on a die casting machine, injection molding machine or the like has been directly fixed on a body of the machine to meet the need for diminishing the total size and weight of the apparatus. As a consequence, the cylinder becomes heated to a high temperature by the heat transmitted from the body which is at a high temperature. This has resulted in using a U packing made of good heat-resistant fluoro-rubber as a sealing member for shutting off leakage between the cylinder case and a piston rod.

In addition, oils which might possibly cause a fire by leaking and coming in contact with a mold at a high temperature usually are not used as an operating fluid for driving the core of a mold such as described above. Instead, a water/glycol mixture containing about 95% of water is used.

However, a sealing member made of above-mentioned fluoro-rubber produces a chemical reaction in contact with water of the water-glycol mixture when it is heated to a high temperature with the result that the seal deteriorates early and a sealing failure occurs. Such a failure causes the operating fluid to leak through the clearance between the cylinder case and the piston rod to the outside. It is therefore necessary to replace frequently the sealing member before it deteriorates, a requirement which makes its maintenance troublesome.

In order to solve such a problem, a system has been proposed as disclosed in Japanese Utility Model Laid-Open Publication No. 64-25508. In that system, the cylinder comprises a cylinder case having a front wall on a front end, a piston slidably fitted into the cylinder case, a piston rod which is coupled to the piston and passes through a hole in the front wall of the cylinder case, and a sealing member attached to the periphery of the hole. An annular passage is defined in the front wall which surrounds the sealing member and a passage which feeds and discharges the fluid is formed in the cylinder case. This prevents deterioration of the seal and simplifies its maintenance.

In addition, a cylinder similar to that of the system as described above, for example, a cylinder as described in Japanese Utility Model Laid-Open Publication No. 61-119609 is known. In that structure a clearance is formed substantially over the full length of a cylinder, between a cylinder tube and a jacket, by enclosing an outside of the cylinder tube with the jacket. The heat from outside is shut off by feeding and discharging cooling water through the clearance.

In either of these fluid cylinder structures, although the heat transmitted through a cylinder case (cylinder tube) to a sealing member can be intercepted along its path, the heat transmitted through the piston to the sealing member cannot be shut off at all. Thus, when the end of this piston rod is connected to any component heated to a high temperature, the heat is directly transmitted through the piston rod to the sealing member which is then heated to a high temperature. The sealing member then deteriorates rapidly due to its contact with the water of the operating fluid and leakage of the fluid results. Such failure can be prevented only by frequent replacement of the sealing member which involves a troublesome and expensive maintenance procedure.

SUMMARY OF THE INVENTION

An object of the present invention is to provide a fluid cylinder which can effectively prevent deterioration of a sealing member and the troublesome maintenance associated with frequent replacement thereof.

This object is achieved by providing a fluid cylinder including a cylinder case having a front wall on a front end and a rear wall on a rear end with a cylinder chamber formed therein. A piston is slidably received in the chamber and a piston rod is coupled to the piston and passes through a hole in the front wall of the case. A sealing member is attached to the periphery of the hole and seals the clearance between the front wall and the piston rod. A fitting rod extends forward from the inside of the rear wall and slidably fits into the piston and the piston rod. A fitting hole in which a space is radially formed inside the sealing member is defined between a front end face of the fitting rod and a bottom face of the fitting hole. A feed passage which feeds fluid into the space and a discharge passage which discharges fluid from the space at the time of feeding fluid into the space are formed in the fitting rod and the cylinder case.

As an example of the use of a structure in accordance with the invention, consider an arrangement in which a fluid cylinder is mounted on a die casting machine, a piston of which is connected to a core of a mold at a high temperature. In this case, heat generated in the core is transmitted through the piston rod to a sealing member which seals a clearance between the piston rod and the front wall of the cylinder. In accordance with the invention, a space is formed in the rod radially inside the sealing member and a cooling fluid is fed through feed passages to the space and is discharged through discharging passages from the space at the time of feeding the fluid into the space. Thus, most of the heat transmitted through the piston rod can be absorbed and carried away and transmission of that heat to the seal can be terminated. The temperature rise of the sealing member is thus limited and its deterioration is reduced, also reducing the necessity for frequent replacement of the sealing member and simplifying maintenance.

BRIEF DESCRIPTION OF THE DRAWING

The Figure is a side elevation in section of an embodiment of the present invention.

DESCRIPTION OF THE PREFERRED EMBODIMENT

An embodiment of the present invention is described hereinafter with reference to the Figure wherein a fluid cylinder 11 is connected to a core of a mold which is mounted on a die casting machine, an injection molding machine, or the like. Fluid cylinder 11 is heated to a high temperature because it is directly attached to the machine which is at a high temperature. Fluid cylinder 11 includes a cylindrical cylinder case 13 in which a cylinder chamber 12 is formed. Cylinder case 13 has a disk-shaped front wall 15 through which an axial through-hole is formed in the center. A disk-shaped rear wall 17 of case 13 has an axial, central through-hole 16 extending longitudinally. A piston 21 divides cylinder chamber 12 into a front chamber 18 and a rear chamber 19 and is slidable within chamber 12. A piston rod 22 is coaxial with cylinder case 13 and is connected to the front end of piston 21, the piston and rod being unitarily formed. Piston rod 22 extends through hole 14, the other end of the rod being coupled with the mold core, not shown, which is at a high temperature.

An annular groove 23 is formed around the internal surface of hole 14, and an U packing 24 is mounted in annular groove 23 as a sealing member. U packing 24 is made of high heat-resistant fluoro-rubber and seals the clearance between opening 14 in front wall 15 of cylinder case 13 and piston rod 22, and thereby prevents leakage of an operating fluid from front cylinder chamber 18. In addition, a dust-sealing member 25 is provided on the inside of hole 14. U packings 26 surround the external periphery of piston 21. Inner ends of cylinder passages 27 and 28 are connected to the front and rear cylinder chambers 18 and 19, respectively, the other ends of these passages being open at the outer surface of cylinder case 13.

The rear end of a substantially cylindrical fitting rod 30 is mounted in opening 16 in rear wall 17 with the tog extending into the interior of case 13. Fitting rod 30 thus extends forward from the inside (front) surface of rear wall 17 and into cylinder chamber 12. Piston 21 and piston rod 22 include a blind fitting hole 31 which extends forward, the fitting hole being coaxial with respect to the fitting rod, and the diameter of hole 31 being approximately the same as that of fitting rod 30. Fitting rod 30 is slidably inserted into fitting hole 31. The relative lengths of rod 30 and hole 31 are selected so that when piston 21 reaches the end of its rearward stroke, the distal end of rod 30 is spaced from the inner end of hole 30, defining a chamber 32 between the end of the rod and the end of the hole. Space 32 lies radially inwardly of U packing 24.

Pairs of annular grooves 33 and 34 are formed between the inner surface of opening 16 in wall 17 and the outer surface of the rear end of fitting rod 30, one groove 33 communicating with one end of a first passage 35 in case 13 and the other groove 34 communicating with one end of a second passage 36 in case 13. The other end of passage 35 opens to the outside of case 13. A feed hole 38 and a discharge hole 37 extend axially along the interior of rod 30, one end of each of holes 37 and 38 communicating with one of grooves 33 and 34 and the other ends of holes 37 and 38 opening into space 32 at the distal end of rod 30.

In front wall 15, an annular passage 40 is coaxial with hole 14 and surrounds U packing 24 radially outwardly thereof. Passage 40 also communicates with annular passage 36 in case 13. A radial third passage 41 provides communication between annular passage 40 and the outer surface of case 13. Annular groove 33; second and third passages 36 and 41; and feed hole 38 constitute a feed path which feeds operating fluid to space 32 and annular passage 40. Annular groove 33; first passage 35; and discharge hole 37 constitute the discharge passage 42 which discharges operating fluid from space 32. An U packing 43 is attached to a rear periphery of fitting hole 31 as a sealing member and seals a clearance between fitting rod 30 and fitting hole 31 so that a fluid fed to space 32 does not leak to rear cylinder chamber 19.

A valve block 45 is detachably mounted on fluid cylinder 11, and a pair of feeding/discharging passages 46 and 47 connected to valve block 45 feed and discharge an operating fluid to the fluid cylinder 11. In order to prevent causing a fire at a high temperature, a liquid mixture of water and glycol, containing 95% or more water, is used. Feeding/discharging passages 46 and 47 and said cylinder passages are connected with each other in valve block 45 and through feeding/discharging passages 48 and 49. Feeding/discharging passages 48 and 49, and inlets of check valves 50 and 51 mounted in valve block 45 are connected with each other through connecting tubes 52 and 53. A restrictor 59 and a control valve 60 in series are connected with outlets of check valves 50 and 51. A pilot pressure directly downstream of restrictor 59 is applied to the control valve, allowing control valve 60 to be opened by force of this pilot pressure when the pilot pressure increases to a predetermined pressure higher than a pressure supplied during moving of piston 21. When control valve 60 is opened, operating fluid is drawn from the feeding/discharging passage 46 or 47 and is supplied to a cooler 54, and is then fed through a connecting tube 55 to the third passage 41 after being cooled. First passage 35 and the inlets of a pair of check valves 56 and 57, mounted in block 45, are connected with each other through a connecting tube 58, and the outlets of check valves 56 and 57 are connected with feeding/discharging passages 46 and 47, respectively.

The operation of this embodiment of this invention is as follows.

When releasing a mold of a machine, a directional control valve (not shown) is first changed over, thereby causing operating fluid to flow from a source of fluid (not shown) into front cylinder 18, for example, through feeding/discharging passage 46, feeding/discharging passage 48, and cylinder passage 27, causing piston 21 and piston rod 22 to move backward. At that time, return fluid is forced out of rear cylinder chamber 19 by piston 21 and is returned to a tank (not shown) through cylinder passage 28, feeding/discharging tube 49, and feeding/discharging passage 47. At that time, pressure of the fluid in the feeding/discharging passage on the high pressure side presses check valve 50 open, and operates constantly control valve 60 by the pilot pressure of the control valve. When piston 21 is moving, however, control valve 60 remains closed because the internal pressure of feeding/discharging passage 46 is at an operating pressure lower than a predetermined pressure.

When piston 21 moves further and reaches the end of its backward stroke, the internal pressure of feeding/discharging passage 46 rises from that operating pressure to the predetermined pressure because piston 21 can not move further. When the internal pressure of passage 46 is thus kept at the predetermined pressure, control valve 60 is opened because said predetermined pressure operates the control valve, and operating fluid which had previously flowed into front cylinder 18, flows into annular passage 40 through connecting tube 52, check valve 50, restrictor 59, control valve 60, cooler 54, connecting tube 55, and the third passage 41. In this process, there might be a possibility of deterioration of the U packing with time due to its reaction with water of the operating fluid at high temperature. However, cooled operating fluid is fed into annular passage 40, thereby causing most of heat being transmitted to cylinder case 13 to be absorbed by the operating fluid flowing through annular passage 40, and heat which might otherwise be transmitted to sealing member 24 is intercepted. Consequently, the temperature of ring 24 rises not so high, its deterioration can be effectively inhibited and its life can be extended.

The operating fluid then flows into space 32 through second passage 36, annular groove 34, and feeding/discharging hole 38. In this step, since space 32 is radially positioned inside sealing member 24, even though heat is transmitted from a highly heated core attached to the end of the piston rod 22 to the piston rod itself, most of the heat can be absorbed by the operating fluid flowing through space 32, and the heat to be transmitted to the sealing member can be intercepted. This allows the U packing temperature to rise not so high and its deterioration to be effectively restricted, extending its life. With this improvement, a material of lower quality than fluoro-rubber may alternatively be used as a sealing member and the manufacturing cost may be reduced. In this embodiment, fluoro-rubber is employed in consideration of safety.

The operating fluid which has absorbed heat is returned to a tank through, in sequence, feeding/discharging hole 37, annular groove 33, first passage 35, connecting tube 58, check valve 57, and feeding/discharging passage 47. In this case, since the fluid supplied to annular passage 40 and space 32 is a fluid for operating the fluid cylinder, it is unnecessary to provide a special source of fluid and the construction may be simple. Moreover, the operating fluid is drawn from between the directional control valve and cylinder chamber 12, and thus constantly circulates through the feeding/discharging passages 46 and 47 almost without exchange returning to the tank on the way. Thereby the fluid passing through feeding/discharging passages 46 and 47 can be refreshed.

On the other hand, when clamping a mold, the operating fluid is fed to rear cylinder chamber 19 through feeding/discharging passage 47 by changing over the directional control valve. At this time, the return fluid returns to a tank through feeding/discharging passage 46. Then, when piston 21 moves and reaches the end or its forward stroke, the internal pressure of feeding/discharging passage 47 rises to the predetermined pressure, thereby opening control valve 60 and supplying the operating fluid to annular passage 40 and space 32. This allows deterioration of the U packing to be effectively inhibited.

In the embodiment described above, the operating fluid for operating fluid cylinder 11 is fed to space 32. However, another fluid, for example, air, water or oil may be supplied from another source to space 32 according to the present invention. Also, in the above embodiment, connecting tubes 55 and 58 are connected with the third and first passages 41 and 35 respectively. However, connecting tubes 55 and 58 may be connected with first and third passages 35 and 41 respectively according to the present invention. Moreover, according to the present invention, only space 32 may be provided without annular passage 40 when an amount of heat is small.

As described above, according to the present invention, most of the heat which is transmitted through the piston rod to the sealing member can be easily intercepted, so that deterioration of a sealing member can be effectively inhibited, thus prolonging the life of the sealing member and simplifying its maintenance.

I claim:

1. A fluid cylinder comprising a cylinder case having a front wall at a front end and a rear wall at a rear end and a cylinder chamber formed within said case;

a piston slideably received in said cylinder chamber;

a piston rod connected to said piston and passing through a through-hole in said front wall of said cylinder case;

a front sealing member mounted on an internal surface of said through-hole for sealing a clearance between said front wall and said piston rod;

means defining a fitting hole in said piston and piston rod;

a fitting rod mounted in said rear wall and extending forwardly from an inside face of said rear wall, said fitting rod being slidably received in said fitting hole in said piston and piston rod;

said fitting hole including a space positioned radially inside said sealing member between a front end face of said fitting rod and an inner end of said fitting hole; and said fitting rod including means defining a feed passage for feeding fluid into said space and a separate discharge passage for discharging fluid from said space while fluid is being fed into said space.

2. A fluid cylinder according to claim 1 and including a through-hole formed through said rear wall of said cylinder case, said fitting rod being inserted forwardly through said through-hole from outside of said case, the rear of said fitting rod and said rear wall being connected with each other.

3. A fluid cylinder according to claim 1, wherein said fitting rod has a substantially cylindrical shape with a central axis, said feed passage and said discharge passage including first and second linear, axially extending holes inside said fitting rod.

4. A fluid cylinder according to claim 1 and including a second sealing member sealing a clearance between a rear internal surface of said fitting hole and an outer surface of said fitting rod, said second sealing member preventing fluid supplied to said space from leaking into said cylinder chamber.

* * * * *